United States Patent [19]

Černý

[11] 4,120,492

[45] Oct. 17, 1978

[54] GRIPPER MECHANISM

[75] Inventor: Arnošt Černý, Blansko, Czechoslovakia

[73] Assignee: Adamovske strojirny, narodni podnik, Adamov, Czechoslovakia

[21] Appl. No.: 822,898

[22] Filed: Aug. 8, 1977

[30] Foreign Application Priority Data

Aug. 16, 1976 [CS] Czechoslovakia ..... 5311/76

[51] Int. Cl.[2] ..... B65H 5/12

[52] U.S. Cl. ..... 271/277; 101/411; 271/82

[58] Field of Search ..... 271/277, 82, 275, 204, 271/206, 228; 101/408–412, 232, 230

[56] References Cited

U.S. PATENT DOCUMENTS 3,839,959 10/1974 Abendroth ..... 271/277 X

FOREIGN PATENT DOCUMENTS 1,244,234 8/1971 United Kingdom ..... 271/277

*Primary Examiner*—Richard A. Schacher

*Attorney, Agent, or Firm*—Burgess, Ryan and Wayne

[57] ABSTRACT

A gripper mechanism for seizing the trailing edges of paper sheets on a transfer drum of a printing machine. A plurality of rollers are resiliently mounted so as to be rotationally shiftable toward the direction of movement of the paper sheet. The rollers are oriented at various oblique angles with respect to the movement direction, with rollers further from the middle axis of the transfer drum being oriented at a greater oblique angle than rollers closer to said axis.

5 Claims, 14 Drawing Figures

GRIPPER MECHANISM

This invention relates to a gripper mechanism for seizing the trailing edges of paper sheets on a transfer drum for turning the sheets, particularly on multicolor printing machines.

On modern multicolor offset printing machines with high output volume, the gripper mechanisms of the transfer drums have to secure an accurate transfer of the paper sheets between the printing units which are arranged adjacent each other.

On multicolor printing machines for printing on one side of the paper sheet as well as on perfecting printing machines (for printing on both sides of the paper sheet), it is necessary to seize the trailing edge of the paper sheet on the surface of the transfer drum and to span the sheet. With regard to the requirements of modern printing machines to also print on heavy or very smooth paper sheets, it is necessary to accurately seize the trailing edges of the paper sheets and to span the paper sheets on the surface of the transfer drum.

Devices are known in which pneumatic suckers are used to seize the trailing edge of the paper sheet. For this purpose the printing machines with such a device are provided with compressors and vacuum air distributing lines which are necessary for the function of such a device with suckers or sucker grippers.

A disadvantage of such vacuum devices is that these devices are complicated, expensive to produce and relatively unreliable. Another known device is provided with a gripper mechanism for seizing the trailing edge of the transferred paper sheet, which mechanism enables only the circumferential spanning of the sheet in the opposite direction to the direction of rotation of the transfer drum.

A disadvantage of said device is that the spanning of the paper sheet, when the sheet is not flattened on the surface of the transfer drum, causes a partial deformation of the sheet and a so-called "folding".

An object of the invention is to provide a gripper mechanism which will enable a simultaneous circumferential and lateral spanning of the paper sheet to be transferred, thus accurately seizing of the trailing edge of the paper sheet, even when thick or tough papers are to be transferred.

The above disadvantages are avoided by a gripper mechanism according to the present invention, where the mechanism consists of rollers which are located obliquely in the mechanism and are arranged symmetrically on both sides of the axis of the gripper system in such a way that the axes of the rollers form with the axis of the gripper shaft an angle of from 0° to 30°, the vertices of the single angles being directed from the central axis of the gripper mechanism. The rollers, which are mounted on pins, are provided with springs on one side. The rollers are located in the gripping part of the roller grippers and bear on a tensioning bar which is fixed on holders. The rollers which are mounted by means of pins on holders, are adjustable by means of a setting screw arranged in the tensioning bar which is fixed on holders. The grippers are fixed on gripper holders which are turnably mounted on the gripper shaft, and seat with their seizing flat on the rollers.

The mechanism according to the invention provides a very simple gripper mechanism in comparison with hitherto known pneumatic devices with suckers for the lateral tensioning of the paper sheet, whereby improved accuracy while turning the sheet is obtained, when the paper sheet is transferred from one drum to the second adjacent cylinder.

Another advantage of the device according to the present invention is that it is not necessary to provide on the printing machine a special compressor or source of vacuum with the required drive motor. By the invention also electric energy is saved during the working on the printing machine.

A specific example of an embodiment of the invention will now be described with reference to the accompanying drawings in which:

FIG. 6 shows a view in the direction of arrow "P" of a paper sheet before the spanning of the sheet on the surface of the transfer cylinder;

FIG. 8 shows a side view of the transfer cylinder with a gripper mechanism according to alternative embodiments of the invention;

FIG. 13 shows in a view in the direction of arrow "S" of the paper sheet before spanning thereof with the mechanism of FIG. 8.

Figure 1:
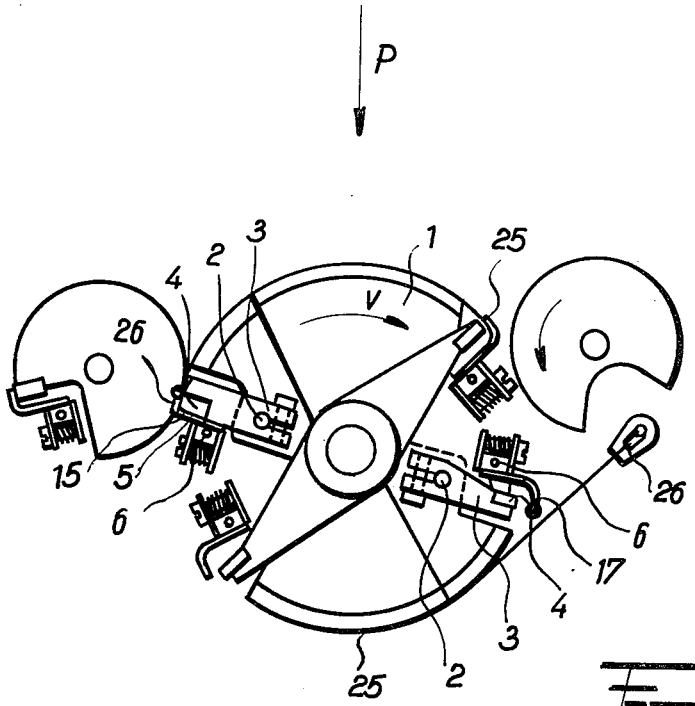
FIG. 1 shows a side view (elevation) of a transfer cylinder with roller grippers according to the invention.
Figure 2:
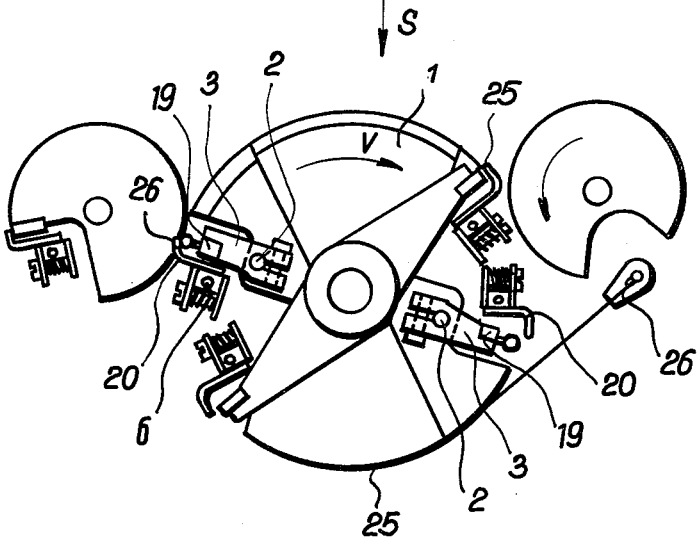
FIG. 2 illustrates a detail side view of the gripper with the roller of FIG. 1, where the roller is located parallel to the axis of the gripper shaft.
Figure 2:
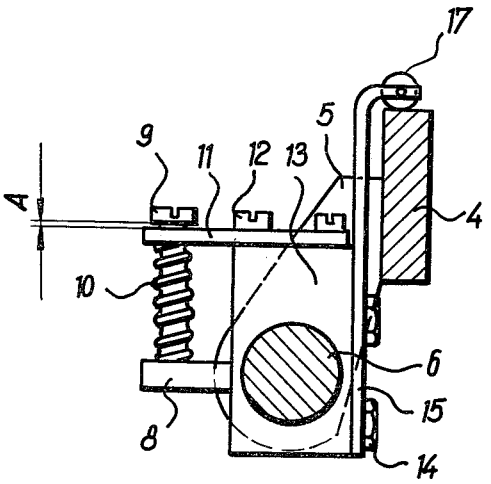
Figure 4:
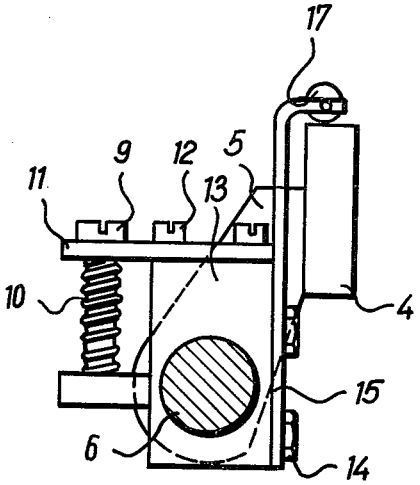
FIG. 4 shows a side view of a detail of the gripper and roller, where the roller is in a skew position.
Figure 3:
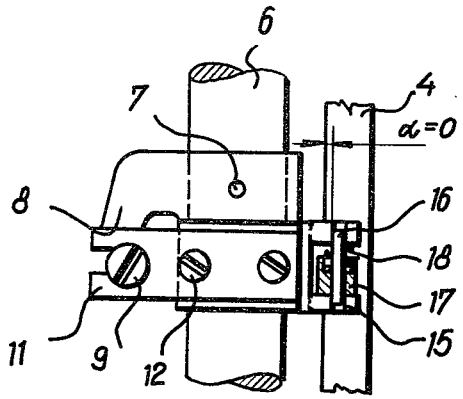
FIG. 3 is a plan view of the gripper and roller of FIG. 2.
Figure 5:
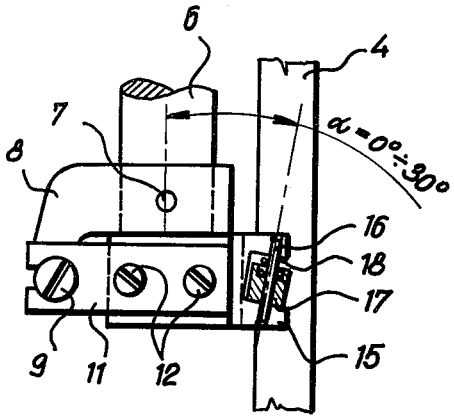
FIG. 5 is a plan view of the gripper and roller of FIG. 4.
Figure 7:
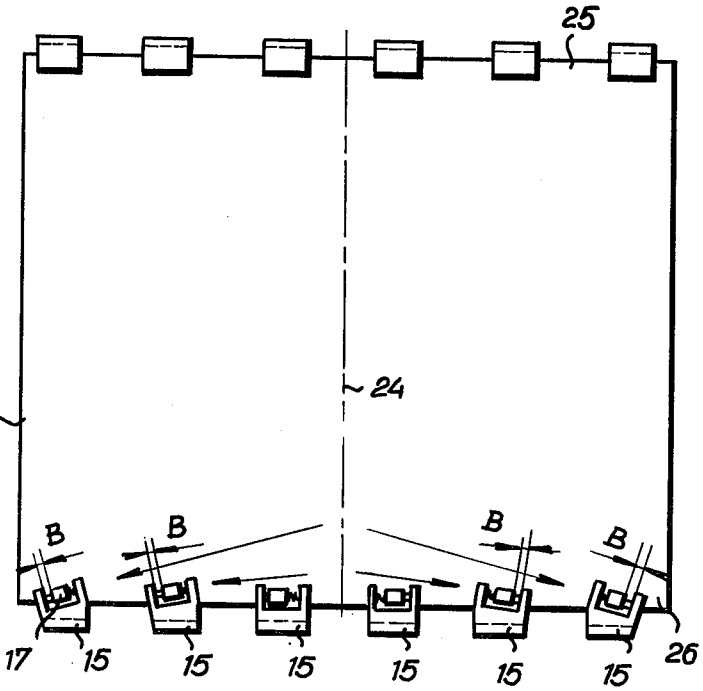
FIG. 7 is a view of the gripper and roller of FIG. 1 in the direction of arrow "P" after the spanning of the paper sheet.
Figure 5:
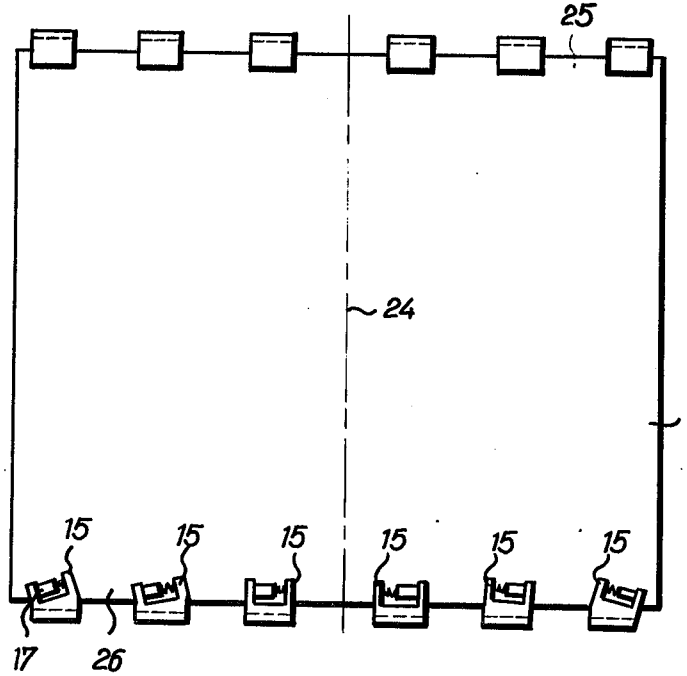

The gripper mechanism according to the invention is arranged on a transfer cylinder 1 of a printing machine and consists of a shaft 2, on which are fixed carriers 3 with a spanning bar 4. On the spanning bar 4 are mounted holders 5, in each of which a gripper shaft 6 is rotatably mounted. On the gripper shaft 6, there are rigidly attached sleeves 8 by means of pins 7. In the sleeves 8 regulating screws 9 are screwed which are provided with a spring 10. The spring 10 bears with one end on a strap plate 11 end with the second end on the sleeve 8. The strap plate 11 is rigidly connected by means of screws 12 with a gripper holder 13 which is rotatably mounted on the gripper shaft 6. On the gripper holder 13 is fixed by means of screws 14 a roller gripper 15 which on one end is provided with a slot and a rigidly attached pin 16, on which on one hand is rotatably mounted a roller 17 and on the other hand a spring 18. One end of the spring 18 engages a recess of the roller 17, and the other end of the spring 18 bears on one wall of the slot. The rollers 17 seat on the spanning bar (see FIGS. 2, 3, 4, 5, 6, 7) and are arranged gradually swung out on the roller grippers 15 in such a way, that the axis of the rollers 17 form with the axis of the gripper shaft 6 an angle $\alpha$ in the range of 0° to 30°, whereby the single angles $\alpha$ are open in a direction toward the middle axis 24 of the gripper mechanism.

Figure 9:
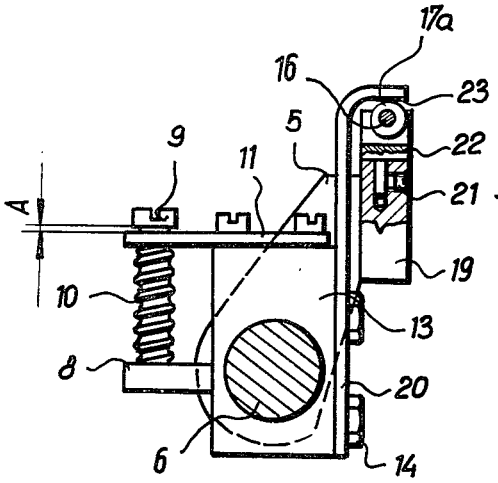
FIG. 9 is a side view of a detail of the gripper with the roller of FIG. 8, where the roller is located on the spanning bar and is parallel to the gripper shaft.
Figure 11:
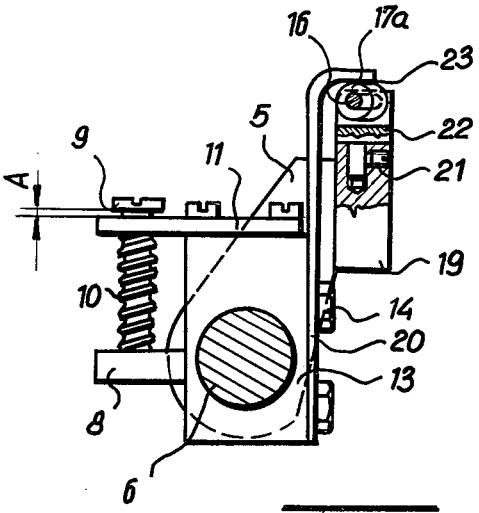
FIG. 11 is a side view of a detail of the gripper mechanism of FIG. 8.
Figure 10:
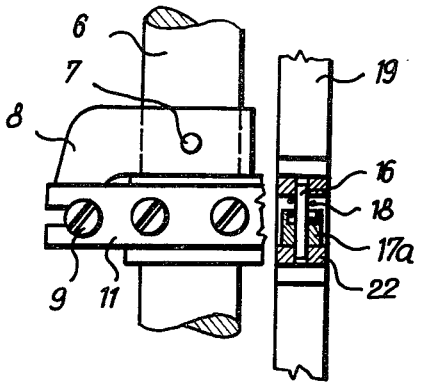
FIG. 10 is a plan view of the gripper and roller of FIG. 9.
Figure 12:
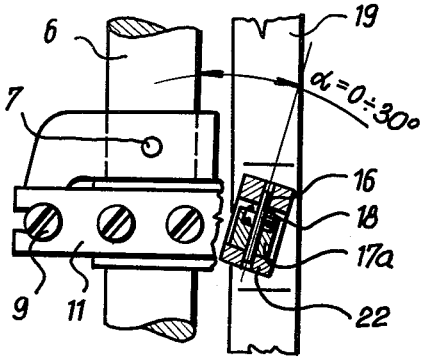
FIG. 12 is a plan view of the gripper and roller of FIG. 11.
Figure 14:
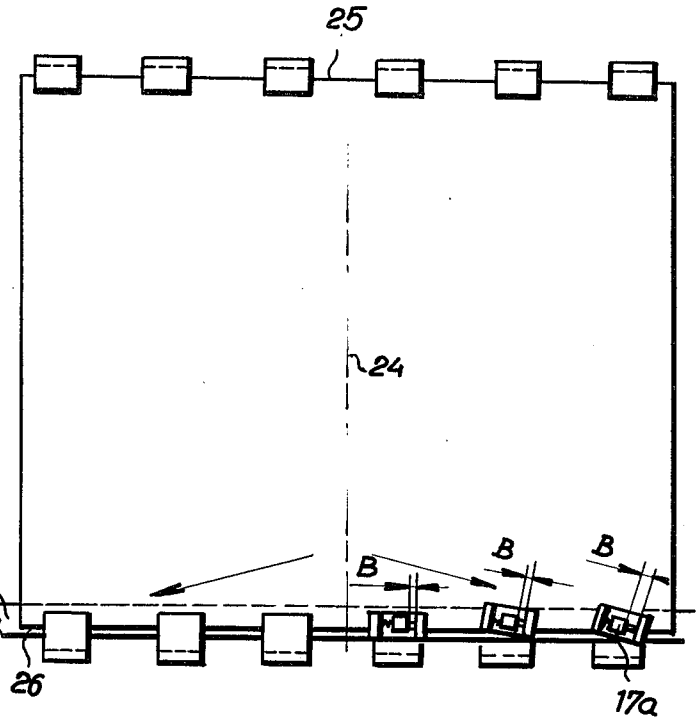
FIG. 14 shows a view in the direction of arrow "S" of a paper sheet while laterally spanning the same.
Figure 15:
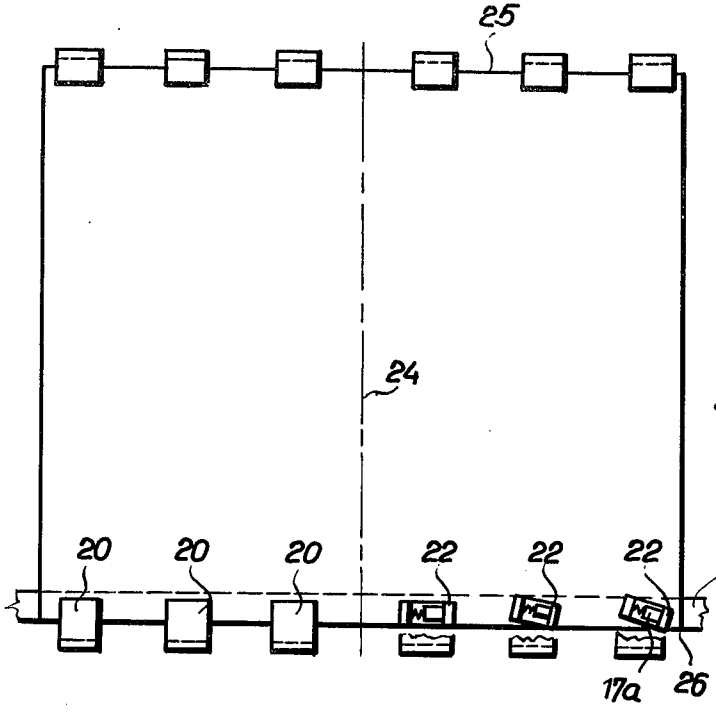

In an alternative embodiment of the invention (see FIGS. 9, 10, 11, 12, 13 and 14) rollers 17*a* are mounted by means of pins 16 in roller carriers 22, whereby each of the springs 18 is mounted on a pin 16 and is located with one end in a recess of the rollers 17*a*. The other end of the spring 18 bears on the inner wall of the roller carriers 22. Grippers 20 are fixed by means of screws 14 on gripper holders 13. The grippers 20 which seize the trailing end 26 of the paper sheet 27 are provided with a seizing flat 23 which seats on the rollers 17*a* which are mounted in the roller carriers 22. The roller carriers 22 are attached by means of set screws 21 on a spanning bar 19 and are gradually and symetrically swung out to both sides arranged about a middle axis 24 of the gripper mechanism in such a way that they form with the gripper shaft 6 an angle $\alpha$ in the range of 0° to 30°. The individual angles $\alpha$ open in a direction toward the middle axis 24 of the gripper mechanism.

The gripper mechanism operates in the following way:

The gripper shaft 6 is turned during one rotation of the transfer drum 1 by means of a mechanism (not illustrated) in such a way, that the rollers 17 seat on the spanning bar 4. With the continued turning of the gripper shaft 6 the springs 10 are compressed, whereby a play "A" is created between the strap plate 11 and the screw 9, which play enables all the rollers 17 to seat on the spanning bar 4. Until this moment the function of the grippers 15 and the rollers 17 is the same. During the rotation of the transfer drum 1 in the direction of arrow "V" the shaft 2 is turned by means of a mechanism (not illustrated) and by this means the complete gripper mechanism is also rotated in the opposite direction to the rotation of the transfer drum 1. As a result the distance between the grippers is enlarged, by which the front edge 25 of the paper sheet 27 is seized, and the grippers 20, by which the trailing edge 26 of the sheet 27 is seized.

Because the rollers 17 are mounted obliquely and forming an angle $\alpha$ with the roller grippers 15, a lateral shifting of the rotating rollers 17 is simultaneously achieved with the circumferential spanning of the paper sheet 27. By the lateral shifting of the rollers 17 a lateral spanning of the paper sheet 27 is achieved which depends on the value of the angle of rotational shifting of the single rollers 17. If the rotational shifting of the rollers 17 is larger than the real uneveness of the trailing edge 26 of the paper sheet 27, it is possible that the paper sheet 27 will slip through between the rollers 17 and the spanning bar 4. When the trailing edge 26 of the paper sheet 27 is spanned, there arises between the side wall of the rollers 17 and the recess (cutout) of the roller grippers 15 a play "B" which is larger at the outermost arranged roller grippers 15 than at the roller grippers 15 which are arranged closer to the middle axis 24 of the gripper mechanism.

With the alternate embodiment of the mechanism according to the invention, where rollers 17*a* are arranged, the function of the gripper mechanism is similar. The value of the angle of rotational shift of the single rollers 17*a* is set by turning the roller holders 22 in the spanning bar 19, whereby the position set in such a way is secured by means of a set screw 21.

LIST OF REFERENCE NUMERALS

1 — Transfer drum
2 — shaft
3 — carrier
4 — spanning bar
5 — holder/for gripper/
6 — gripper shaft
7 — pin
8 — sleeve
9 — regulating screw
10 — spring
11 — strap plate
12 — screw
13 — gripper holder
14 — screw
15 — gripper
16 — pin
17 — roller
18 — spring
17*a* — roller
19 — spanning bar
20 — gripper
21 — setting screw
22 — roller carrier
23 — seizing flat
24 — middle axis
25 — front edge of the paper sheet
26 — trailing edge of the paper sheet
27 — paper sheet

What I claim is:

1. A gripper mechanism for seizing the trailing edge of a paper sheet on the surface of a transfer drum for turning said paper sheet, comprising a plurality of rollers obliquely arranged in the gripper mechanism and mounted symmetrically on both sides of a middle axis of the gripper mechanism, the axes of the rollers forming an angle $\alpha$ with the axis of the gripper shaft in the range from 0° to 30°, the individual angles $\alpha$ opening in a direction toward the middle axis of the gripper mechanism, the angle $\alpha$ for rollers relatively close to the middle axis being less than the angle $\alpha$ for rollers relatively remote therefrom.

2. A gripper mechanism according to claim 1, wherein the rollers are rotationally mounted on pins and are provided with springs on one side thereof.

3. A gripper mechanism according to claim 1, further comprising a spanning bar coupled to said gripper mechanism, wherein the rollers are rotationally mounted by means of pins on the seizing part of the gripper mechanism, and abut said spanning bar.

4. A gripper mechanism according to claim 3, wherein the rollers are adjustably attached by means of set screws to said roller spanning bar.

5. A gripper mechanism according to claim 4, further comprising having seizing flats, said grippers seating with their seizing flats on the rollers, the grippers being fixed on gripper holders which are rotatably mounted on a gripper shaft.

* * * * *